US006986832B2

(12) United States Patent
Lamminen et al.

(10) Patent No.: US 6,986,832 B2
(45) Date of Patent: Jan. 17, 2006

(54) ARRANGEMENT FOR MIXING FLOWS IN PAPERMAKING PROCESS

(75) Inventors: Perttu Lamminen, Tampere (FI); Matti Hietaniemi, Jyskä (FI); Juhani Sams, Jyväskylä (FI); Kati Lindroos, Tampere (FI)

(73) Assignee: Metso Paper Inc., Helsinki (FI)

( * ) Notice: Subject to any disclaimer, the term of this patent is extended or adjusted under 35 U.S.C. 154(b) by 28 days.

(21) Appl. No.: 10/080,038

(22) Filed: Feb. 19, 2002

(65) Prior Publication Data

US 2002/0121350 A1 Sep. 5, 2002

Related U.S. Application Data

(63) Continuation of application No. 10/080,038, filed on Feb. 19, 2002.

(60) Provisional application No. 60/290,362, filed on May 11, 2001.

(30) Foreign Application Priority Data

Feb. 21, 2001 (FI) ..... 20010335

(51) Int. Cl.
*D21F 1/06* (2006.01)

(52) U.S. Cl. ..... 162/381; 162/336; 162/380; 162/57; 162/183; 162/185; 162/216; 366/336; 366/337; 366/341; 366/348; 422/224; 422/227; 422/228

(58) Field of Classification Search ..... 162/381, 162/380, 57, 183, 185, 216, 336; 366/336, 366/337, 341, 348; 422/224, 227, 228
See application file for complete search history.

(56) References Cited

U.S. PATENT DOCUMENTS

| | | | | |
|---|---|---|---|---|
| 3,219,483 | A * | 11/1965 | Goos et al. | 127/28 |
| 3,698,430 | A | 10/1972 | Van Gasselt et al. | |
| 4,123,800 | A | 10/1978 | Mazzei | |
| 4,808,007 | A * | 2/1989 | King | 366/337 |
| 4,861,165 | A * | 8/1989 | Fredriksson et al. | 366/165 |
| 5,452,955 | A | 9/1995 | Lundström | |
| 5,556,200 | A | 9/1996 | Ekholm et al. | |
| 5,685,342 | A | 11/1997 | Ekholm | |
| 6,562,196 | B1 * | 5/2003 | Huovila et al. | 162/198 |

FOREIGN PATENT DOCUMENTS

| | | |
|---|---|---|
| DE | 42 11 291 | 10/1993 |
| EP | 0 063 729 | 11/1982 |
| FI | 941365 | 9/1995 |

(Continued)

OTHER PUBLICATIONS

Copy of Official Action for Finnish Priority Appl. No. FI-20010335 dated Sep. 25, 2001.

(Continued)

*Primary Examiner*—Mark Halpern
(74) *Attorney, Agent, or Firm*—Alston & Bird LLP

(57) ABSTRACT

The invention relates to a method and a mixer for mixing flows of a papermaking process. In the invention, a first flow is conveyed through a tube, and turbulence is generated in it by means of form parts located on the inner periphery of the tube. The mixing zone of the mixer comprises feed openings on the inner periphery of the tube for feeding a second flow from a feed channel outside the tube into the first flow, whereby the flows are mixed as a result of the turbulence generated by the form parts. According to a preferred embodiment of the invention, at least one form part comprises a feed opening.

15 Claims, 4 Drawing Sheets

FOREIGN PATENT DOCUMENTS

| | | |
|---|---|---|
| FI | 104384 | 1/2000 |
| JP | 07204480 | 8/1995 |
| WO | WO 99/64666 | * 12/1999 |
| WO | WO-01/27386 | 4/2001 |

OTHER PUBLICATIONS

Copy of International Search Report for PCT/FI02/00141, completed Jun. 3, 2002 (mailed Jun. 7, 2002).

Chemical Pulping: Book 6A (ISBN 952-5216-06-3); pp. A629-A630; Published by Fapet Oy in cooperation with the Finnish Paper Engineers' Association and TAPPI; Helsinki, Finland.

Kamyr Symposium/Kamyr Management Symposium (Kamyr is former name of Kvaener Pulping AB); Nov. 23-24, 1990; Jakarta, Indonesia; Pages—Contents (2 pgs.), 132, 135, 136, 137, 147, Program (2 pgs.) and Participant List (3 pgs).

Copy of Communication from European Patent Office issued on Sep. 30, 2004 in corresponding European Appl. No. 0270010.

* cited by examiner

ARRANGEMENT FOR MIXING FLOWS IN PAPERMAKING PROCESS

CROSS-REFERENCE TO RELATED APPLICATIONS

This application is a continuation of U.S. application Ser. No. 10/080,038, filed Feb. 19, 2002, which claims the benefit of U.S. Provisional Application No. 60/290,362, filed May 11, 2001, which are hereby incorporated in their entirety by reference.

BACKGROUND OF THE INVENTION

1) Field of the Invention

The invention relates to a method of mixing flows with each other in a papermaking process, according to which method a first flow is fed through a tube, and one or more second flows is/are fed into the first flow via a feed opening which is in connection with the space limited by said tube.

The invention further relates to a mixer comprising a tube, through which the first flow of the papermaking process is conveyed; and a feed opening which is in connection with the space limited by the tube and with a feed channel for mixing a second flow into the first flow through the feed opening.

The invention further relates to feeding equipment of a head box of a paper machine, comprising a tube through which a first flow is conveyed to the head box; a feed opening which is in connection with the space limited by the tube and with the feed channel for feeding a second flow into the first flow through the feed opening; and a process component, such as a pump or screen, which is arranged in said tube before the head box.

2) Description of Related Art

There are a plurality of objects in different papermaking processes in which other pulp flows or various additives, such as coloring, filling and retention agents, are mixed into the main flow formed of liquid and pulp. It is typical to mix retention chemicals that bind solid matter particles into the fiber suspension flow headed for the head box of a paper machine, which retention chemicals allow improvement of the retention of fines and filler agents in the wire section of the paper machine. The mixing of different components can be performed with what are called tube mixers. Thus, the additive is conveyed into the pulp flow through tubes or nozzles arranged on the side of the pulp tube. However, the arrangement has not brought about a mixing result that would be sufficiently good. Attempts have also been made to feed a jet of additive at a very fast rate into the pulp flow, whereby the desired effect would have been for the additive jet to better penetrate into the pulp flow. Unfortunately, the problem here is that some additives, such as a retention agent, adhere to the surface of the fiber or other solid matter in an undesirable manner when being fed at a fast rate, which results in what is called flat conformation, for example, and the additive no longer has the desired retention relative to the filling agent or fines. Further, the result may be undesired degradation of the retention agent because of too great shear forces. Due to these aspects, the final product is subjected to detrimental variation of the profile.

Further, in order to improve the mixing, injection nozzles can be used that extend some distance into the inside of the pulp tube. The problem is, however, that the ends of the nozzles inside the pulp tube gather impurities, which makes the feed of the additive more difficult and deteriorates the quality of the final product.

An object of this invention is to provide a novel and an improved arrangement for mixing two separate flows in a tube.

SUMMARY OF THE INVENTION

The method according to the invention is characterized in that the first flow is conveyed in the tube to the mixing zone, which mixing zone comprises on the inner periphery of the tube at least one form part, the control surfaces of which form part extend a predetermined distance from the inner periphery of the tube towards the middle of the tube, and which control surfaces together with the inner periphery of the tube define the inner surface of the tube; that turbulence is generated in the first flow by means of said control surfaces; and that the second flow is fed to the mixing zone portion into the first flow through one or more feed openings positioned on the inner surface of the tube.

Further, the mixer according to the invention is characterized in that a mixing zone has been formed in the tube, comprising at least one form part on the inner periphery of the tube; that the form part comprises control surfaces which extend a predetermined distance from the inner periphery of the tube towards the middle of the tube for generating turbulence in said flow in the mixing zone of the tube; that the inner periphery of the tube and the control surfaces of the form part define the inner surface of the tube in the mixing zone; and that the mixer comprises in the mixing zone portion on the inner surface of the tube one or more feed openings which is/are in connection with the feed channel and through which a second flow can be fed into the first flow.

Further, feeding equipment according to the invention is characterized in that the tube comprises a mixing zone extending from the nearest process component preceding the head box to the head box; that the mixing zone comprises at least one form part on the inner periphery of the tube; that the form part comprises control surfaces extending a predetermined distance from the inner periphery of the tube towards the middle of the tube for generating turbulence in said flow in the mixing zone of the tube; that the inner periphery of the tube and the control surfaces of the form part define the inner surface of the tube in the mixing zone; and that in the portion of the mixing zone, the inner surface of the tube is provided with one or more feed openings, which is/are in connection with the feed channel and through which the second flow can be fed into the first flow.

The essential idea of the invention is that the first flow of the papermaking process is conveyed in a tube which is provided with one or more form parts arranged on the inner periphery of the tube. The form parts comprise control surfaces which extend a predetermined distance from the inner periphery of the tube towards the middle of the tube. The form parts control the flow flowing in the tube and generate turbulence in the flow. The zone that begins in the flowing direction after the nearest process component preceding the form part, i.e. after a pump or screen, for instance, and that ends after the form parts at the point where the mixing effect of the turbulence generated by the form parts has essentially weakened is in this application called the mixing zone of the tube. The inner periphery of the tube and the control surfaces of the form parts define together the inner surface of the tube in the mixing zone, i.e. the surface that contacts the flow flowing through the mixing zone. In accordance with the idea of the invention, the mixing part comprises one or more feed openings on the inner surface of the tube, which openings are in contact with the feed channels outside the tube. From said feed openings, at least one second flow is fed into the first flow flowing in the tube. The form parts function as mechanical mixing members, and the turbulence generated by them mixes the flows efficiently with each other. Owing to the form parts, the penetration of the second flow into the first flow is improved. The rate of the flow flowing through the mixing zone can be kept relatively slow, and yet, good mixing can be achieved. Owing to the mixing that is better than previously, problems resulting from poor mixing can be avoided in the manufacturing stages after the mixer. The invention enables manufacture of products of more uniform quality. In addition, since the mixing is good, expensive additive chemicals can be used in amounts smaller than previously. Earlier, it has been necessary to compensate for the poor mixing by feeding excessive amount of additive chemicals into the pulp flow.

The essential idea of a preferred embodiment of the invention is that at least one of the form parts in the mixing zone comprises a feed opening which is in connection with the feed channel. Through the feed opening in the form part, a second flow is fed from the outside of the tube into the first flow flowing in the tube. The form parts allow the flow to be fed closer to the middle of the flow flowing in the tube, which makes the mixing of the flows more efficient. Since the feed opening is at the same level as the control surface of the form part, and further, since the form part is designed to remain easily clean, the form part and the feed opening arranged in it do not gather impurities.

The essential idea of a second preferred embodiment of the invention is that the first flow is a mixture of liquid and solid matter used in papermaking, for example a mixture of fibers and water, and the second flow is paper making chemical, such as a retention agent.

The essential idea of a third preferred embodiment of the invention is that the tube mixer is arranged on the feeder line headed for the head box of a paper machine, after a mechanical screen. Thus, the first component of a two-component retention agent is at first fed via the feed openings in the mixing zone into the first flow flowing in the tube, and the flocs made by the first component are broken by means of form parts after the feeding point, after which the second retention agent component is fed either from the point where the form parts break the flocs or thereafter. In this way, the shear forces required for the breaking of the flocs are achieved by means of form parts, and not with mechanical screens, as previously. Hence, the rejecting effect of screens and the degradation of the chemical in the screen can be avoided, and in this the consumption of expensive retention agents can be reduced.

BRIEF DESCRIPTION OF THE SEVERAL VIEWS OF THE DRAWINGS

The invention is described in greater detail in the attached drawings, in which.

Figure 1:
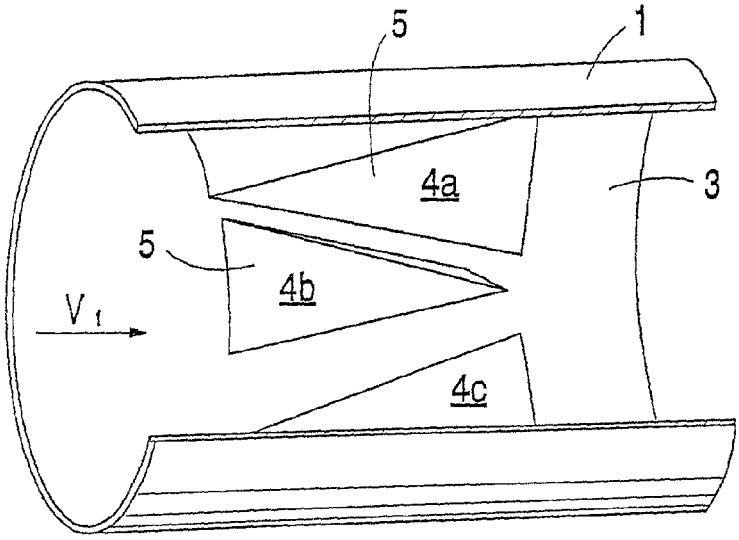
FIG. 1 shows a schematic and perspective view of a tube mixer.

Figures are greatly simplified for the sake of clarity. The reference numerals of the figures correspond to each other.

DETAILED DESCRIPTION OF THE INVENTION

FIG. 1 shows the basic structure of a tube mixer without equipment relating to the feed of an additive or the like. The mixer comprises a tube 1, through which a first flow $V_1$ is conveyed; the flow can be a mixture of liquid and solid matter, such as a mixture of fiber and water, or it can be mere liquid. Form parts 4*a* to 4*c* are arranged on the inner periphery 3 of the tube 1, the cross-section of the tube being wave-like at this point. The form parts protrude from the inner periphery of the tube and form control surfaces 5, by means of which the flow $V_1$ is controlled and turbulence is generated in the flow. The number, form and dimensioning of the form parts and their positions relative to each other are designed in a case-specific manner. Preferably, there are at least three form parts arranged on the inner periphery 3 of the tube at even distances from each other and in the direction of the longitudinal axis of the tube substantially at the same point. One preferred shape of form parts is indicated in FIG. 1. Seen from the direction of flow, the area of the wedge-shaped form part is at first approximately zero, because its front edge is a line-like surface in the direction of the periphery. When proceeding towards the direction of flow, the line-like surface grows in the direction of the radius into a cross-section in the form of a sector of a circle. At the same time as it is growing in the direction of the radius of the tube 1, the form part begins to diminish in the direction of the periphery, and the rear edge of the form part becomes line-like again. Hence, the solids in the flow, such as fibers, do not adhere to it, but the form is substantially without stagnation points and remains thus easily clean. The form parts similar to those shown in FIG. 1 can also be arranged in the way opposite to what is shown, i.e. in such a way that the sharp edge of the radius is directed forwards. Combining a desired number of form parts having an appropriate shape and dimensioning at the mixing point of the tube allows an appropriate mixer to be tailored for each purpose.

Later, in FIGS. 2 to 5 and FIG. 7, the form parts are illustrated for the sake of clarity in a simplified manner as wedge-like parts. In addition, figures only illustrate a part of the form parts of the mixer.

Figure 2:
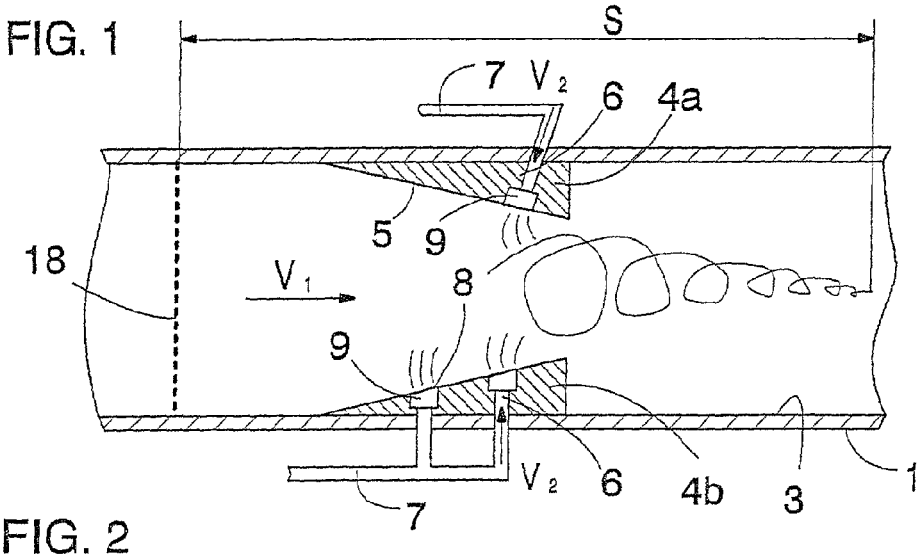
FIGS. 2 to 4 show a schematic view of mixers according to the invention, seen from the side and being cut out.

FIG. 2 shows a preferred application of the invention. The form parts 4*a* to 4*b* are here provided with a transverse boring 6. The first end of the boring is in connection with the feed channel of the additive component or another feed channel 7 outside the tube 1, and at the second end of the boring 6 there is a feed opening 8, which is in connection with the space limited by the tube 1. Thus, the second flow $V_2$ can be fed from the feed channel 7 into the first flow $V_1$, whereby the flows mix with each other owing to the turbulence caused by the form parts. The second flow $V_2$ can be liquid or a mixture of liquid and solid matter. The second flow $V_2$ is for example a mixture of water and fiber pulp, a papermaking chemical, such as a retention or coloring agent, or it may be for example a filler agent, dilution water or a paper machine filtrate, e.g. clear or cloudy water. Further, the second flow may be for example wire water or head box pulp. Furthermore, the second flow may be a combination of an appropriate gas and solid matter.

In connection with the feed opening 8, there may be a nozzle 9, which feeds the second flow $V_2$ into the first flow $V_1$ in the desired manner. The nozzle allows control of the flow rate of the flow $V_2$ and thus also the penetration into the first flow $V_1$. In the same way, the nozzle allows generation of turbulence in the second flow to be fed, which improves the mixing of the flows with each other. Further, for instance the additive can be fed together with the feed water through the nozzle, whereby the dosing of the additive can be affected by the control of the flow and pressure of the feed water. As can yet be seen when observing the lower form part in the figure, there may be several feed openings in one form part. Either different substances or, as the figure shows, a single substance can be fed from the several feed openings in a single form part.

Figure 3:
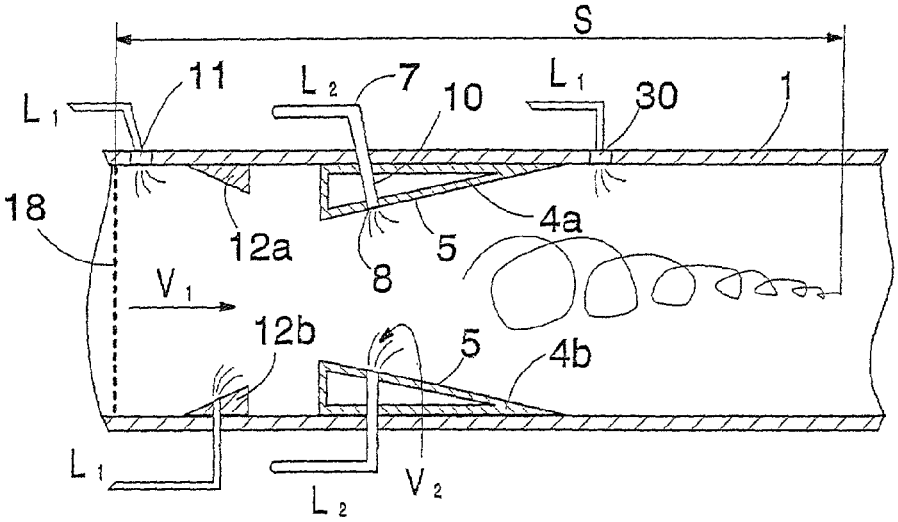

FIGS. 2 and 3 show the mixing zone S of the tube, where one or more second flows $V_2$ is/are mixed into the first flow $V_1$, the second flow being led from the feed channel 7 outside the tube 1. The mixing zone S can begin as early as before the front edge of the first form part. The mixing zone begins as early as after the nearest process component 18 preceding the form part in the flowing direction, for instance a pump or screen, because in this case, too, the form part can contribute to the uniform distribution of the additive. The mixing part S ends after the form parts at the point where the mixing effect of the turbulence generated by the form parts has substantially weakened.

EXAMPLE

The diameter of the tube was 350 mm, the greatest dimension in the radial dimension of the tube was 120 mm, and the length of the form part in the direction of the axis of the tube was 200 mm. Pulp having the flow rate of 3 m/s in the tube was conveyed in the tube to the head box of a paper machine. The mixing turbulence weakened at a distance of 1,100 mm from the rear edge of the form part.

In the solution of FIG. 3, the form parts 4*a* and 4*b* are hollow, whereby one or more injection tubes 10 is/are conveyed through at least some of the form parts, along which injection tubes the second flow $V_2$ is fed from the feed channel 7 into the inside of the tube 1. The outermost ends of the injection tubes 10 thus form a feed opening 8, which is at substantially the same level as the outer surface of the form part in such a way that no stagnation points gathering impurity are brought about in the form part. The outermost end of the injection tube can be provided with an appropriate nozzle. Further, additives or other flows can be fed into the first flow $V_1$ even before the form parts 4*a* and 4*b*. Thus, nozzles 11 arranged on the inner periphery of the tube 1 can be used, or alternatively, second form parts 12*a* and 12*b* are arranged on the inner periphery of the tube 1, through which parts the additive component can also be fed. Also the second form parts 12*a*, 12*b* achieve turbulence in the flow $V_1$ and improve the mixing. The solution according to FIG. 3 enables the use of two-component additives. Thus, the first additive component $L_1$ is fed before the form parts 4*a*, 4*b*, the second additive component $L_2$ being fed later through the form parts 4*a*, 4*b* and/or after the form parts for instance via a nozzle 30. This enables the feed of both components of the two-component retention agent only after the machine screen. Together with the solids of the pulp mixture, the first retention agent component forms what are called flocs, which are degraded by means of the shear force provided by the form parts 4*a*, 4*b* of the mixer. Then, the second retention agent component is fed via the feed openings 8 in the form parts and/or via the nozzle 30, which component regathers the flocs. This solution allows a substantial reduction in the consumption of the retention agent compared with the solutions presently in use, in which the first retention agent component is dosed before the machine screen, in which case, typically, part of the expensive retention agent mixes with the reject separated by the screen.

As can be seen from FIGS. 2 and 3, the feed openings can be directed in a desired manner, either perpendicularly relative to the first flow, upstream or downstream, depending on the situation.

Figure 4:
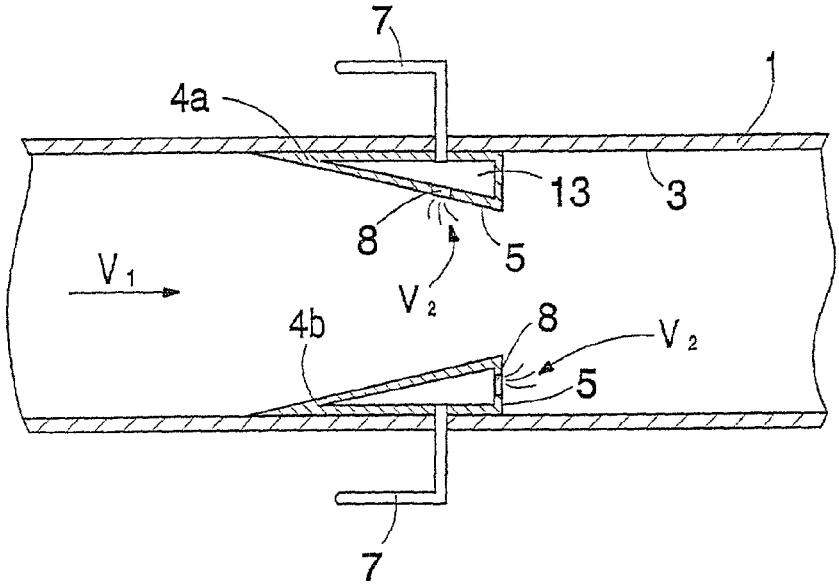

FIG. 4 shows a mixer having hollow form parts 4*a*, 4*b*. Thus, for example, an additive component is fed from the feed channel 7 into the hollow space 13 of the form parts, which additive component is dosed into the space limited by the tube 1 through one or more feed openings 8 formed on the control surface 5 of the form part. The number, form and position of feed openings can be selected according to the situation. The feed openings can be formed on the control surface of the form part in accordance with a predetermined pattern.

Figure 5:
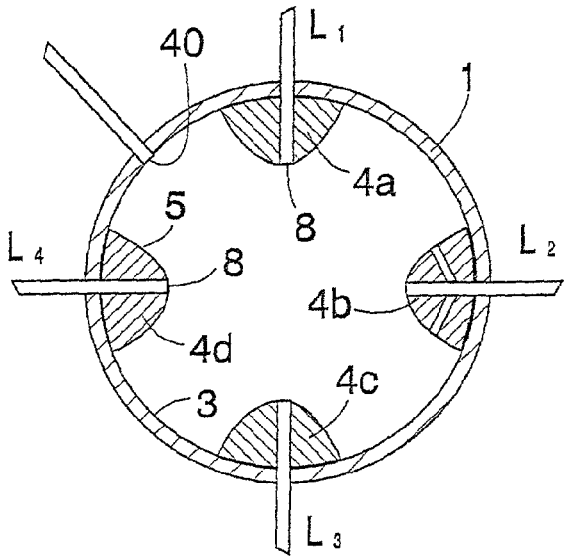
FIG. 5 shows a schematic view of a mixer according to the invention, seen from the longitudinal direction and as a cross-section.

FIG. 5 shows a mixer according to the invention, seen from the end of the tube 1. In this case, the form parts 4*a* to 4*d* have a curved control surface 5. Through each form part, a different flow is conveyed into the inside of the tube 1. Further, a flow can be fed into the first flow through one or more feed openings 40 positioned between the form parts.

Figure 6A:
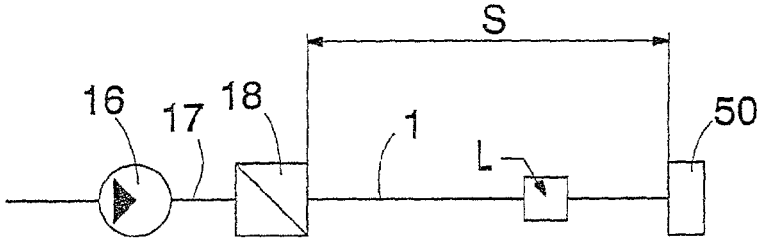
FIGS. 6*a* to 6*c* show a schematic view of applications according to the invention.

FIG. 6*a* shows an application according to the invention. A pulp component is fed with a pump 16 along the primary line 17 to the machine screen 18, after which the pulp component is conveyed in the tube 1 to the head box 50 of the paper machine. In this case, the mixing zone S begins after the nearest process component preceding the head box, i.e. after the screen 18. Form parts have been arranged in the tube portion between the screen 18 and the head box 50, and additive flows required are supplied to the mixing zone in the manner according to the invention. The screen 18 can be a screen structure known per se, such as a slotted basket screen or hole basket screen. In the application according to FIG. 6*b*, the pulp line is divided into at least two secondary lines 19 after the screen 18, along which the pulp component is conveyed to the head boxes of a multiply wire section of the paper machine, i.e. to a multilayer head box 20, which doses a web having two or several layers to the wire section of the paper machine. At least one of the secondary lines 19 comprises a mixer 21 according to the invention, which mixer enables for instance the feed of a two-component retention agent after the machine screen. The mixing of each secondary line and the addition of additives can be controlled separately.

Figure 6B:
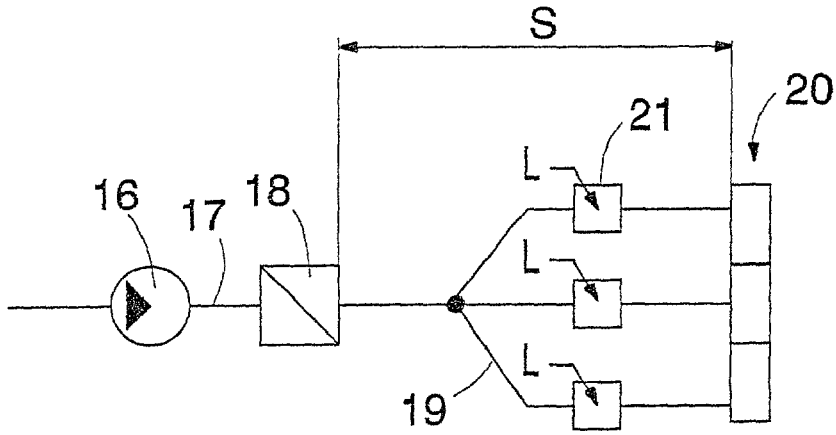
Figure 6C:
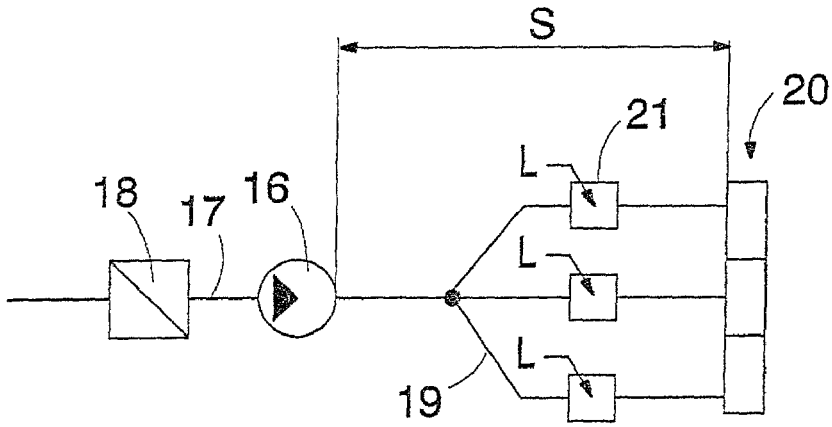

The solution shown in FIG. 6*c* substantially corresponds to the one shown in FIG. 6*b*, except that here the nearest process component preceding the head box (20) is a pump (16). Thus, the mixing zone (S) extends from the pump (16) to the head box (20).

Owing to the improved penetration and mixing, additives can be fed from one or more smaller feed conduits, whereby in the paper machine, the variation of the web profile in the machine direction and cross-direction is reduced. In other words, the web profile is thus more even and there is not so much need for fixing. When the scale of mixing is reduced in the way described above, the mixing result is better. Thus, the formation, i.e. the small-scale basis weight variation is improved, in other words the formation reading is reduced. Owing to the reduction in the profile variation and the basis weight variation, the feed point of the retention agent, for example, can be positioned closer to the head box. Thus, chemicals can be saved, because the effect of some retention agents weakens as the effective time increases. The cross-machine profile of the filling agent cannot be fixed in the paper machine. Weak or uneven feed of retention agent results in a poor filling agent profile. The feed of the retention agent can be improved by means of the invention, whereby the filling agent retention is more even, and therefore also the filling agent profile is more even.

Figure 7:
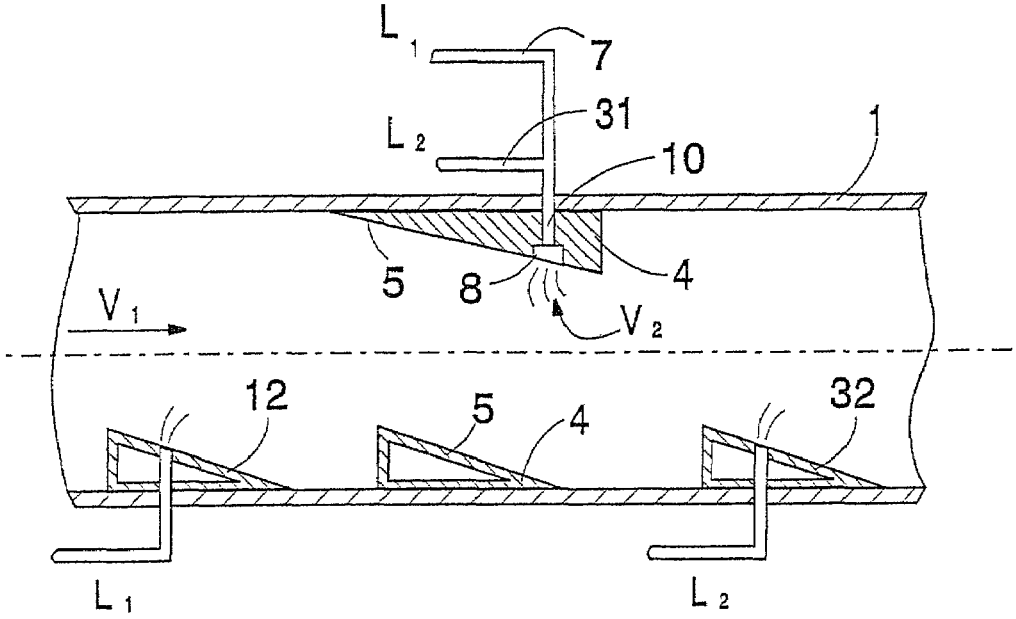
FIG. 7 further shows a schematic view of an application according to the invention, seen from the side and being cut out.

The upper embodiment of FIG. 7 illustrates a mixer in which a mixture of two different components $L_1$ and $L_2$ is fed through the form part 4. Thus, for example some filling agent or fiber pulp can be fed via the first feed channel 7, and for example some chemical can be fed via the second feed channel 31, whereby the components are mixed with each other before the mixture formed thereof is dosed into the flow $V_1$. If the first component to be mixed is a mixture of liquid and solid matter, for example a paper machine filtrate, and the second component is a retention agent, the time of the pre-mixing of said components is fixed in such a way that the retention agent does not have time to react in an undesired way with the solid matter particles in the first component. A solution of this kind enables dilution of a retention agent and other chemicals also with impure liquids containing solid matter before they are fed into the first flow.

In the lower solution of FIG. 7, the mixer comprises three successive form parts in the longitudinal direction of the tube. The additive $L_1$ is fed through the first form part 12 and a second additive $L_2$ is fed through the third form part 32. The second, i.e. the middlemost, form part 4 functions as a static mixing member. A solution of this kind is well applicable to the dosing of two-component chemicals.

The drawings and the related specification are only intended to illustrate the idea of the invention. The details of the invention can vary within the scope of the claims. Thus, the shape of the form part can be selected according to the need. The form part can thus be wedge-shaped or pyramid-shaped, a part comprising curved surfaces, or otherwise appropriately designed. What is essential is that the form part comprises control surfaces which achieve a sufficient turbulence in the pulp flow for the purpose of mixing. In addition, it is essential that the form parts remain clean in the flow of pulp components. Further, the form parts can be arranged to be adjustable, whereby their position relative to the tube (on the periphery of the tube and in the longitudinal direction of the tube) and/or their shape can be adjusted to achieve the desired mixing. The control surfaces of the form parts can be controlled to extend a desired distance from the periphery of the tube towards the inner part of the periphery of the tube, for example.

That which is claimed:

1. A mixer comprising a tube, through which the first flow of the papermaking process is conveyed; and a feed opening which is in connection with the space limited by the tube and with a feed channel for mixing a second flow into the first flow through the feed opening; wherein a mixing zone has been formed in the tube, comprising at least one form part on an the inner periphery of the tube;

the form part comprises control surfaces which extend a predetermined distance from the inner periphery of the tube towards the middle of the tube and which extend a predetermined circumferential distance that is less than the entire circumference of the inner periphery of the tube for generating turbulence in said flow in the mixing zone of the tube;

the inner periphery of the tube and the control surfaces of the form part define the inner surface of the mixing zone; and the inner surface of the mixing zone is provided with one or more feed openings which is/are in connection with the feed channel and through which a second flow can be fed into the first flow, the first of the one or more feed openings for supplying the second flow being located at or after a front edge of the first form part in the direction of the first flow, wherein the axial middle of the tube is free of any feed opening.

2. A mixer according to claim 1, wherein at least one form part comprises at least one feed opening, and the feed opening is in connection with a feed channel outside the tube.

3. A mixer according to claim 2, wherein the mixer comprises at least two successive form parts, seen in the longitudinal direction of the tube.

4. A mixer according to claim 2 or 3, wherein the form part comprises a transverse boring of the tube, the first end of which boring is in connection with the feed channel outside the tube, and the second end is in connection with the space limited by the tube.

5. A mixer according to claim 2 or 3, wherein the form part is hollow, and the feed channel is in connection with the hollow space of the form part, and one or more feed openings has/have been formed on the control surface of the form part.

6. A mixer according to claim 2 or 3, wherein the position of the form part relative to the tube is adjustable.

7. A mixer according to claim 2 or 3, wherein the shape of the form part is adjustable.

8. Feeding equipment of a head box of a paper machine, comprising a tube through which a first flow is conveyed to the head box;

a feed opening which is in connection with the space limited by the tube and with the feed channel for feeding a second flow into the first flow through the feed opening; and a process component which is arranged in said tube before the head box, wherein the tube comprises a mixing zone extending from the nearest process component preceding the head box to the head box;

the mixing zone comprises at least one form part on an inner periphery of the tube;

the form part comprises control surfaces extending a predetermined distance from the inner periphery of the tube towards the middle of the tube and which extend a predetermined circumferential distance that is less than the entire circumference of the inner periphery of the tube for generating turbulence in said flow in the mixing zone of the tube;

the inner periphery of the tube and the control surfaces of the form part define the inner surface of the mixing zone, and the inner surface of the mixing zone is provided with one or more feed openings, which is/are in connection with the feed channel and through which the second flow can be fed into the first flow, the first of the one or more feed openings for supplying the second flow being located at or after a front edge of the first form part in the direction of the first flow, wherein the axial middle of the tube is free of any feed opening.

9. Feeding equipment according to claim 8, wherein at least one form part comprises at least one feed opening, and the feed opening is in connection with the feed channel outside the tube.

10. Feeding equipment according to claim 8 or 9, wherein the feeding equipment comprises in the mixing zone before the form parts a feed opening for conveying the first component of a two-component retention agent into the fiber suspension flowing through the tube, and the feeding equipment comprises in the mixing zone a second feed opening for feeding the second component of the retention agent into the flow mixed by the turbulence generated by the form parts.

11. Feeding equipment according to claim 8 or 9, wherein the tube is divided after the nearest process component preceding the head box into at least two secondary tubes, along which the first flow is conveyed from said process component to a multilayer head box or to the head boxes of a multiply wire section, and at least one secondary tube comprises at least one form part and at least one feed opening for feeding the second flow into the flow flowing through the secondary tube.

12. A mixer comprising a tube, through which the first flow of the papermaking process is conveyed; and a feed opening which is in connection with the space limited by the tube and with a feed channel for mixing a second flow into the first flow through the feed opening; wherein a mixing zone has been formed in the tube, comprising at least one form part on an inner periphery of the tube;

the form part comprises control surfaces which extend a predetermined distance from the inner periphery of the tube towards the middle of the tube and which extend a predetermined circumferential distance that is less than the entire circumference of the inner periphery of the tube for generating turbulence in said flow in the mixing zone of the tube;

the inner periphery of the tube and the control surfaces of the form part define the inner surface of the mixing zone; and the inner surface of the mixing zone is provided with one or more feed openings which is/are in connection with the feed channel and through which a second flow can be fed into the first flow, at least one of the feed openings for supplying the second flow being located in at least one of the control surfaces of at least one form part, wherein the axial middle of the tube is free of any feed opening.

13. A mixer according to claim 12, wherein the mixer comprises at least two successive form parts, seen in the longitudinal direction of the tube.

14. A mixer according to claim 12, wherein the form part comprises a transverse boring of the tube, the first end of which boring is in connection with the feed channel outside the tube, and the second end is in connection with the space limited by the tube.

15. A mixer according to claim 12, wherein the form part is hollow, and the feed channel is in connection with the hollow space of the form part, and one or more feed openings has/have been formed on the control surface of the form part.

* * * * *